US005707294A

United States Patent [19]

Fischer

[11] Patent Number: 5,707,294

[45] Date of Patent: Jan. 13, 1998

[54] BASE SUSPENDED SINGLE SWING

[76] Inventor: Amy S. Fischer, 66 Nicole Ter., Bridgewater, N.J. 08807

[21] Appl. No.: 729,045

[22] Filed: Oct. 10, 1996

[51] Int. Cl.[6] ..... A63G 9/02

[52] U.S. Cl. ..... 472/118; 472/125; 297/281

[58] Field of Search ..... 472/118, 121, 472/122, 125; 297/273, 276, 281; 248/370, 138, 295.11

[56] References Cited

U.S. PATENT DOCUMENTS

| | | | |
|---|---|---|---|
| 1,360,495 | 11/1920 | Bugenhagen . | |
| 1,707,167 | 3/1929 | Marshall | 472/120 |
| 1,731,658 | 10/1929 | Gnuechtel | 472/120 |
| 1,927,223 | 9/1933 | Sollanek . | |
| 2,510,223 | 6/1950 | Hart | 472/120 |
| 2,531,069 | 11/1950 | McCarty | 472/121 |
| 2,616,485 | 11/1952 | Robbins . | |
| 2,980,164 | 4/1961 | McNeil | 472/121 |
| 3,829,086 | 8/1974 | Lelong . | |
| 4,046,375 | 9/1977 | Lelong . | |

*Primary Examiner*—Kien T. Nguyen
*Attorney, Agent, or Firm*—Kenneth P. Glynn

[57] ABSTRACT

The present invention is a base suspended single swing which includes at least one adjustable safety member for regulating the swinging height profiles. The swing is suspended by a plurality of pivotal suspension members and is supported by a base and a plurality of upright supports. The swing itself is defined by a pivotal swinging base which has a single seat attached off center, a footrest area and a gripping handle and at least one impact member for engaging the safety member. The swing is self-propelled and is intended for use by small children and toddlers. The off center single seat construction allows the swing to be placed in motion easily by a child passenger. The safety member is adjustable such that a parent or the like may regulate the uppermost peak swinging level. The present invention swing may have a generally open support base construction or may have an enclosed construction which simulates a boat, car and the like.

17 Claims, 3 Drawing Sheets

BASE SUSPENDED SINGLE SWING

BACKGROUND OF THE INVENTION

1. Field of the Invention

The present invention is directed to suspended swing devices and more particularly to pivotal single seat, self propelled suspended swings for toddlers and children which comprise an adjustable swinging level regulator and a fixed base.

2. Information Disclosure Statement

Conventional suspended swings come in a variety of shapes and sizes and are suspended in a variety of ways. Many of these conventional swings are suspended from a support structure which enables the swings to comprise unique swinging paths and profiles.

The following five patents represent different variations of suspended swings which exemplify the art.

U.S. Pat. No. 1,360,495 to George Herman Bugenhagen teaches a lawn swing that is supported from supporting legs such that a user may pass through the legs without any danger of interfering with the legs. The swing has a centrally located seat and a foot rest portion and has a grip handle. The handle and foot rest portion, however, shift relative to the seat when the swing is in motion.

U.S. Pat. No. 1,927,223 to Emil Sollanek et al. teaches a self propelled suspended swing capable of supporting a plurality of users. The swing is suspended by a pair of V-shaped side frames and comprises a pivotal linear seat and a pivotal connecting bar.

U.S. Pat. No. 2,616,485 to Homer R. Robbins teaches a convertible swing structure having a plurality of different embodiments. One such embodiment shows a double seated suspended swing which is supported by a support structure. The swing is suspended by two opposed ladders and has a pivotal swinging base member which has two opposed seats.

U.S. Pat. No. 3,829,086 to Marion Pasteur Lelong teaches a swing for two persons having a plurality of overhead pivot points and a pair of suspension ropes diverging downwardly from the pivot points to swinging spreader assemblies. The swing travels endwise and sidewise and is capable of describing an apparent figure-eight pattern while in motion.

U.S. Pat. No. 4,046,375 to Marion Pasteur Lelong teaches a swing for two persons having a plurality of overhead pivot points and a pair of suspension ropes diverging downwardly from the pivot points to swinging spreader assemblies. The swing travels endwise and sidewise and is capable of describing an apparent figure-eight pattern while in motion. The swing is combined with a seesaw means for inducing endwise swinging.

Notwithstanding the prior art in this field, it is believed that the present invention, which comprises a base suspended single swing and an adjustable safety member for regulating swinging peak profiles, as described herein, is neither taught nor rendered obvious.

SUMMARY OF THE INVENTION

The present invention is a base suspended single swing which includes at least one adjustable safety member for regulating the swinging height profiles. The swing is suspended by a plurality of pivotal suspension members and is supported by a base and a plurality of upright supports. The swing itself is defined by a pivotal swinging base which has a single seat attached off center, a footrest area, a leg safety bar, a gripping handle and at least one impact member for engaging the safety member. The swing is self-propelled and is intended for use by small children and toddlers. The off center single seat construction allows the swing to be placed in motion easily by a child passenger. The safety member is adjustable such that a parent or the like may regulate the uppermost peak swinging level. The present invention swing may have a generally open support base construction or may have an enclosed construction which simulates a boat, car and the like.

BRIEF DESCRIPTION OF THE DRAWINGS

The present invention will be more fully understood when the specification herein is taken in conjunction with the drawings appended hereto, wherein.

DETAILED DESCRIPTION OF THE PRESENT INVENTION

The present invention is a base suspended single swing which includes at least one adjustable safety member for regulating the swinging height profiles. The swing is suspended by a plurality of pivotal suspension members and is supported by a base and a plurality of upright supports. The swing itself is defined by a pivotal swinging base which has a single seat attached off center, a footrest area and a gripping handle and has at least one impact member for engaging the safety member. A leg safety bar is included to prevent a child's legs from swinging out into the path of the moving swing. The swing is self-propelled and is intended for use by small children and toddlers. The off center single seat construction allows the swing to be placed in motion easily by a child passenger and to be kept in motion by a child passenger's rocking movements. The safety member is attached to two of the upright supports and is adjustable upwardly and downwardly such that a parent or the like may regulate the uppermost peak swinging level. The present invention swing may have a generally open support base construction or may have an enclosed construction which simulates a boat, car, bus and the like.

The present invention swing may be constructed out of molded plastic, pvc, rubber, metal or any other suitable substance known to be used in the art. The present invention swing may also be constructed in a variety of sizes and shapes without exceeding the scope of the present invention.

Figure 1:
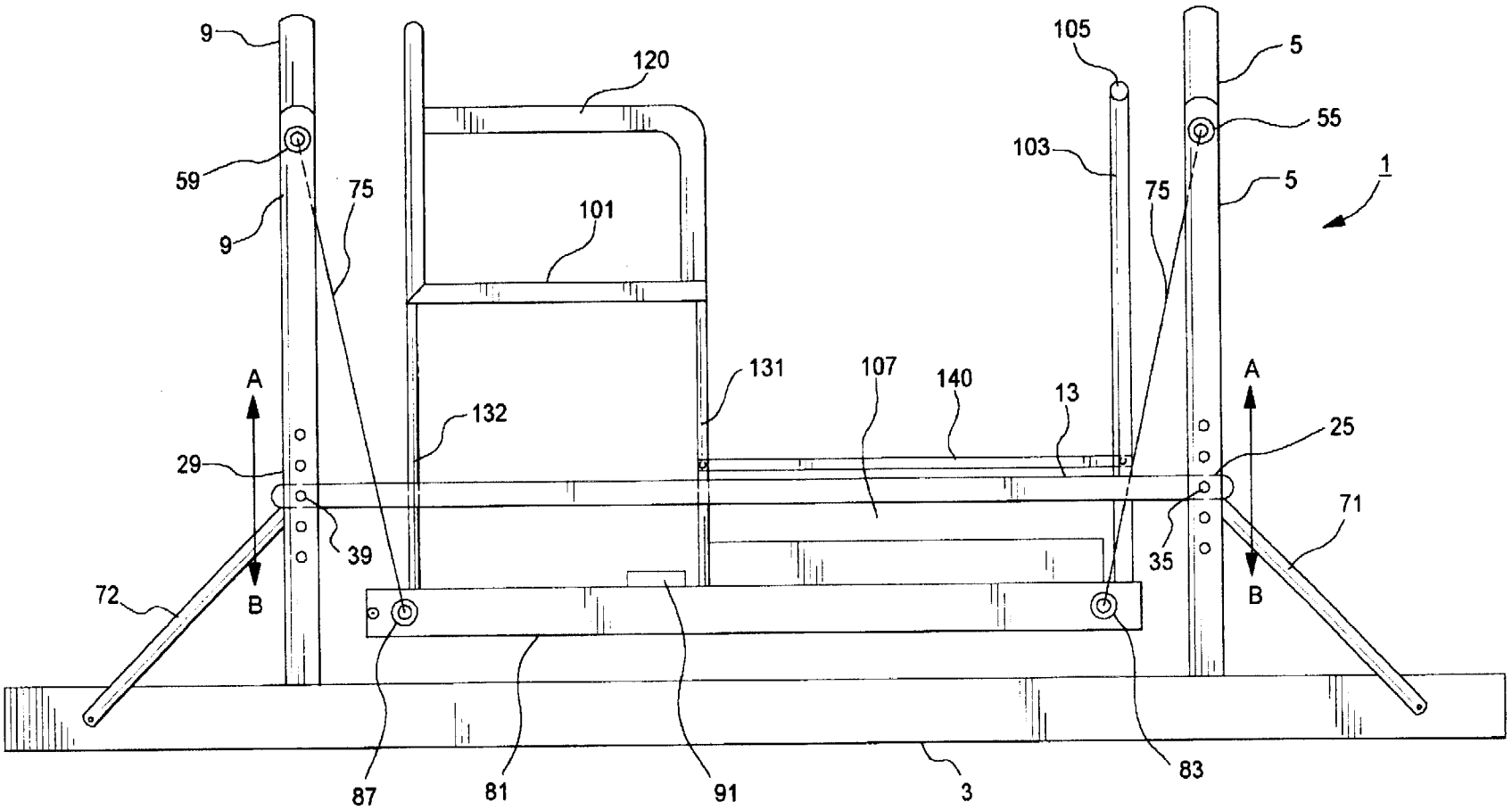
FIG. 1 shows a side length view of a present invention base suspended single swing.
Figure 2:
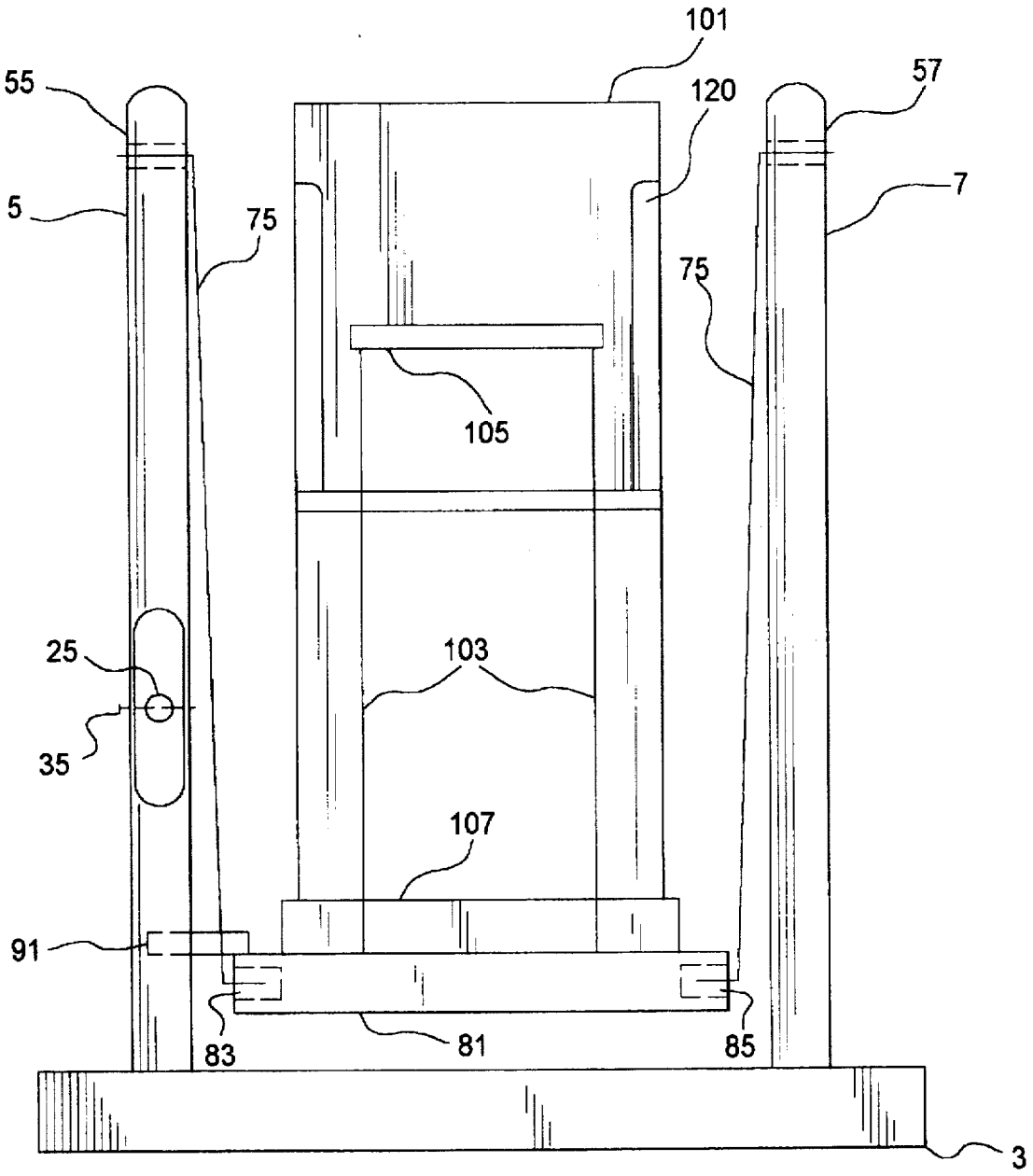
FIG. 2 shows a side width view of a present invention base suspended single swing as shown in FIG. 1; and, FIG. 3 shows a side length view of a present invention base suspended single swing having an alternative embodiment support base.

FIG. 1 shows a side length view of a present invention base suspended single swing and FIG. 2 shows a side width view of a present invention base suspended single swing as shown in FIG. 1.

Referring to FIGS. 1 and 2, swing 1 has a support base 3 which is attached to upright supports 5, 7, 9 and 11 (7 and 11 not shown). As shown, supports 5 and 9 are coupled by adjustable safety member 13 which extends parallel to base 3. Here safety member 13 is shown as a rod which extends through cut-outs 25 and 29 of supports 5 and 9 and is adjustable upwardly and downwardly in directions A and B, as illustrated by double sided arrows. Pins 35 and 39 are removably inserted into supports 5 and 9 and hold safety member 13 in place once a parent or the like selects a desired height. Angle brackets 71, 72, 73 and 74 extend from base 3 and are connected to upright supports 5, 7, 9 and 11 at cut-outs 25, 29, 31 and 33 to provide additional support for swing 1.

Swinging base 81 is pivotally suspended between supports 5, 7, 9 and 11 by suspension arms 75. Shown here at rest, swinging base 81 is pivotally suspended by suspension arms 75 which are connected at one end to pivot points 55, 57, 59 and 61 (57 and 61 not shown) and at their opposite ends to pivot points 83, 85, 87 and 89 (85 and 89 not shown), respectively. Suspension arms 75 are biased inwardly with respect to upright supports 5, 7, 9 and 11 when swinging base 81 is at rest. In other words, pivot points 83, 85, 87 and 89 are non-parallel with pivot points 55, 57, 59 and 61. The relative inward bias may be anywhere from 10° to 45°, for example. Thus, the exact dimensions of swinging base 81 may vary with respect to the corresponding size of support base 3 without exceeding the scope of the present invention.

When placed in motion by a child passenger, swinging base 81 pivots back and forth such that swinging base 81 remains parallel with support base 3 at all times. An impact member 91 extends outwardly from a portion of swinging base 81 and engages safety member 13 when swinging base 81 reaches a pre-selected peak swinging height. A pad 92 (not shown) may be added to impact member 91 to cushion the impact and any subsequent jarring effect. Thus, a parent or the like may regulate the peak swinging height so as to compensate for a child passenger's age, size and any other special conditions. Accordingly, safety member 13 functions as a vital safety component which makes the present invention swing more accommodating to younger child passengers than other swings currently available in the art.

A seat 101 is attached off center to swinging base 81 and a footrest 107 is attached to base 81 adjacent to seat 101. Seat 101 may have cushioning and arms 120 for added comfort and safety. A handle bar 105 is attached to swinging base 81 by a pair of upright rod members 103 that extend upwardly from footrest 107 such that a child may grip handle bar 105 when seated in seat 101. While in motion, seat 101 and footrest 107 do not pivot relative to swinging base 81 but are instead fixedly mounted to swinging base 81. Thus, the off center seat construction provides for easy self-propelled pivotal movement when a child rocks back and forth in seat 101. A pair of leg safety bars 140 (141 not shown) extend from leg 131 of seat 101 to upright rod members 103. This prevents a child's legs from swinging out into the path of the swing. Leg safety bar 141 extends similarly on other side.

It is to be understood that while safety member 13 is shown as being adjustably located within cut-outs located within supports 55 and 59, any other adjusting means may be employed without exceeding the scope of the present invention, e.g. tongue and groove components, flexible extensions and the like. It is also to be understood that an additional safety member and impact member may be employed without exceeding the scope of the present invention. Furthermore, the size and height of the chair and handle bar may vary without exceeding the scope of the present invention.

Figure 3:
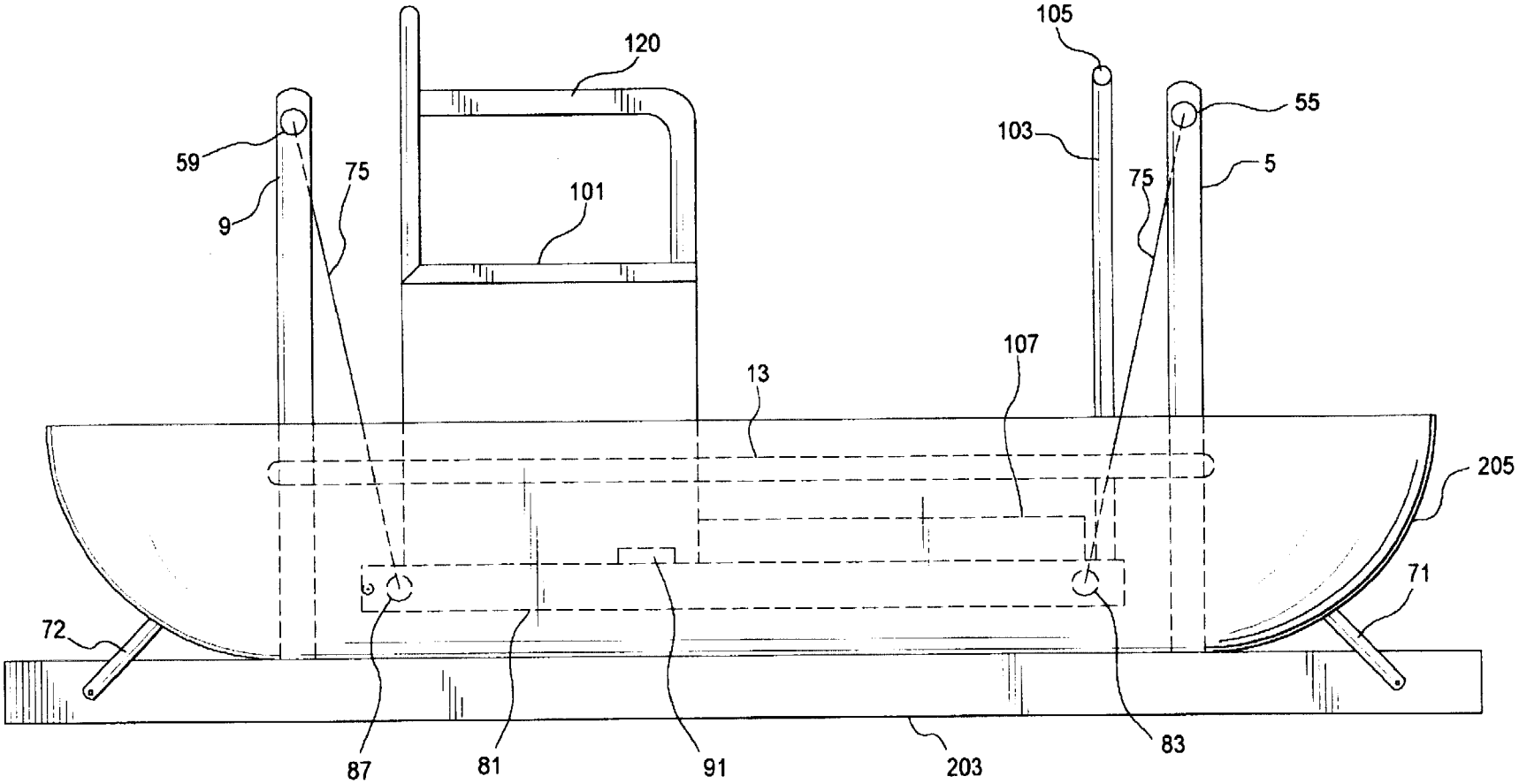

FIG. 3 shows a side length view of a present invention base suspended single swing employing an alternative embodiment enclosed suspension base. Identical parts are identically numbered.

Referring to FIG. 3, support base 203 has enclosure member 205 which extends from base 203 and which encloses a substantial portion of the swing. While enclosure member 205 is shown as being shaped like a hull of a boat, this depiction is merely illustrative. Thus, enclosure member 205 may be constructed in any variety of shapes such as a body of a car, a bus, a train, a plane and or any other suitable configuration without exceeding the scope of the present invention.

Obviously, numerous modifications and variations of the present invention are possible in light of the above teachings. It is therefore understood that within the scope of the appended claims, the invention may be practiced otherwise than as specifically described herein.

What is claimed is:

1. A base suspended single swing device comprising:

(a) a support base;

(b) a plurality of upright supports attached to said support base, at least two of said upright supports having adjustable safety member receiving means for receiving an adjustable safety member therein;

(c) a swinging base having at least a first end and a second end opposite said first end, said swinging base having a chair attached at said first end, said swinging base having a footrest and a safety handle attached adjacent to said chair, said swinging base also having a safety impact member extension thereon; and (d) means for pivotally attaching said swinging base to said plurality of upright supports.

2. The base suspended single swing device of claim 1 wherein said pivotal attachment means are a plurality of suspension arms having a first and second end, each of said suspension arms being pivotally attached at said first end to a pivot point defined within said upright supports and being pivotally attached at said second end to a pivot point defined within said swinging base.

3. The base suspended single swing device of claim 2 wherein said pivot points are non-parallel such that said suspension arms are biased inwardly when said swinging base is in a resting position.

4. A base suspended single swing device comprising:

(a) a support base having an enclosure member thereon;

(b) a plurality of upright supports attached to said support base, at least two of said upright supports having adjustable safety member receiving means for receiving an adjustable safety member therein;

(c) a swinging base having at least a first end and a second end opposite said first end, said swinging base having a chair attached at said first end, said swinging base having a footrest and a safety handle attached adjacent to said chair, said swinging base also having a safety impact member extension thereon; and (d) means for pivotally attaching said swinging base to said plurality of upright supports.

5. The base suspended single swing device of claim 4 wherein said pivotal attachment means are a plurality of suspension arms having a first and second end, each of said suspension arms being pivotally attached at said first end to a pivot point defined within said upright supports and being pivotally attached at said second end to a pivot point defined within said swinging base.

6. The base suspended single swing device of claim 5 wherein said pivot points are non-parallel such that said suspension arms are biased inwardly when said swinging base is in a resting position.

7. The base suspended single swing device of claim 4 wherein said enclosure member is shaped like a hull of a boat.

8. The base suspended single swing device of claim 4 wherein said enclosure member is shaped like a car.

9. The base suspended single swing device of claim 4 wherein said enclosure member is shaped like a bus.

10. The base suspended single swing device of claim 4 wherein said enclosure member is shaped like a plane.

11. A base suspended single swing device comprising:

a) a support base;

b) a plurality of upright supports attached to said support base;

c) at least one safety member extending parallel to said support base;

d) means for adjustably attaching said at least one safety member to two of said plurality of upright supports;

e) a swinging base having a chair positioned off center on said swinging base and further having a footrest and a handle attached to said swinging base adjacent to said chair;

f) a safety impact member extension attached to said swinging base for engagement with said safety member;

g) a pair of leg safety bars running parallel to said at least one safety member, said leg safety bars extending from said chair to said handle; and h) means for pivotally attaching said swinging base to said plurality of upright supports.

12. The base suspended single swing device of claim 11 wherein said pivotal attachment means are a plurality of suspension arms having a first and second end, each of said suspension arms being pivotally attached at said first end to a pivot point defined within said upright supports and being pivotally attached at said second end to a pivot point defined within said swinging base.

13. The base suspended single swing device of claim 12 wherein said pivot points are non-parallel such that said suspension arms are biased inwardly when said swinging base is in a resting position.

14. The base suspended single swing device of claim 13 wherein an enclosure member is attached to said support base.

15. The base suspended single swing device of claim 11 wherein an enclosure member is attached to said support base.

16. The base suspended single swing device of claim 11 wherein said safety impact member extension is padded.

17. The base suspended single swing device of claim 11 wherein said chair has a pair of arm rests.

* * * * *